US005777554A

United States Patent [19]

Lehmann et al.

[11] Patent Number: 5,777,554

[45] Date of Patent: *Jul. 7, 1998

[54] MOTION SENSITIVE REMINDER

[76] Inventors: Roger W. Lehmann, 808 Ashley Ave., Brielle, N.J. 08730; Michael I. Satten, 26 Cow La., Kings Point, N.Y. 11024

[ * ] Notice: The term of this patent shall not extend beyond the expiration date of Pat. No. 5,421,532.

[21] Appl. No.: 801,447

[22] Filed: Feb. 18, 1997

Related U.S. Application Data

[63] Continuation-in-part of Ser. No. 764,823, Dec. 12, 1996.

[51] Int. Cl.[6] ..... G08B 13/14

[52] U.S. Cl. ..... 340/571; 340/568; 340/693; 340/527

[58] Field of Search ..... 340/568, 571, 340/691, 692, 693, 527, 573, 528, 529, 530, 686, 457

[56] References Cited

U.S. PATENT DOCUMENTS

| | | | |
|---|---|---|---|
| 3,436,726 | 4/1969 | Dentz | 340/457 |
| 3,870,818 | 3/1975 | Barton et al. | 395/2.67 |
| 4,016,538 | 4/1977 | Miller | 340/457 |
| 4,051,397 | 9/1977 | Taylor | 310/329 |
| 4,229,663 | 10/1980 | Sibley | 307/9.1 |
| 4,291,301 | 9/1981 | Chan | 340/568 |
| 4,412,205 | 10/1983 | Von Kemenczky | 340/331 |
| 4,980,667 | 12/1990 | Ames | 340/427 |
| 5,294,914 | 3/1994 | Dallas | 340/432 |
| 5,315,289 | 5/1994 | Fuller et al. | 340/532 |
| 5,316,515 | 5/1994 | Hyman et al. | 446/28 |

*Primary Examiner*—Jeffery A. Hofsass
*Assistant Examiner*—Benjamin C. Lee
*Attorney, Agent, or Firm*—Caesar, Rivise, Bernstein, Cohen & Pokotilow, Ltd.

[57] ABSTRACT

A compact motion sensitive reminder device that is an integral part of almost any movable item and which emits an audio signal when the item is initially moved from a stationary condition and then remains silent during the item's use, and emits the audio signal again only after a certain amount of time that the movable item has remained stationary.

24 Claims, 2 Drawing Sheets

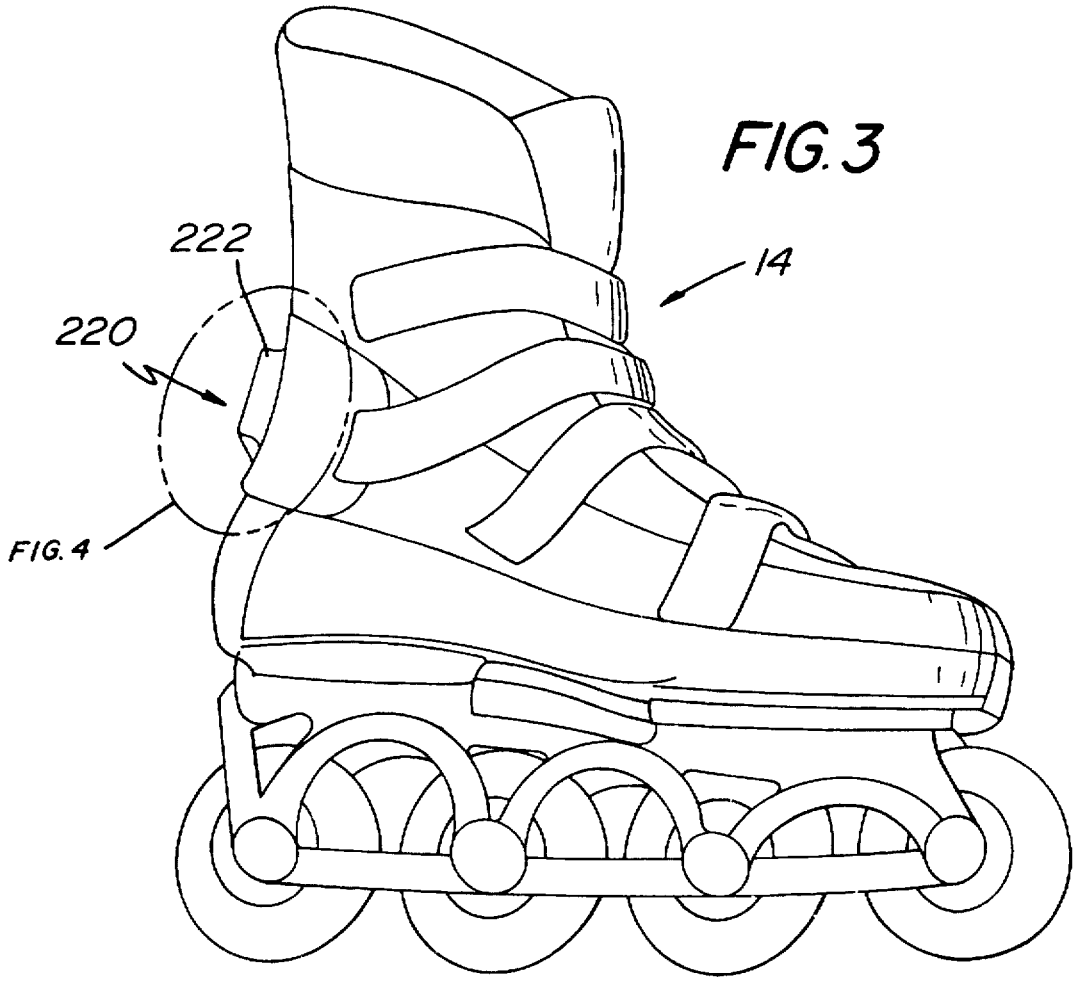
FIG. 3
222
220
14
FIG. 4
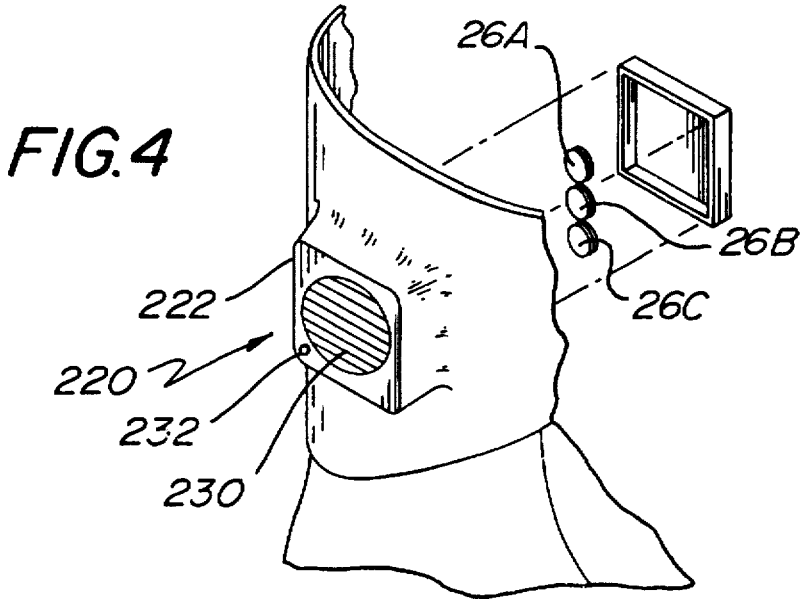
FIG. 4
26A
26B
26C
222
220
232
230

MOTION SENSITIVE REMINDER

This application is a Continuation-in-Part of Co-Pending application Ser. No. 08/764,823 filed Dec. 12, 1996, entitled MOTION SENSITIVE REMINDER and whose disclosure is incorporated by reference herein.

The invention relates generally to automatic advisory devices and more specifically to automatic audible devices that are attachable to items that can be moved such as apparel, sports equipment, luggage, or any movable components on a stationary device, etc. for reminding the user to take appropriate action upon initial movement of the item.

BACKGROUND OF THE INVENTION

The following U.S. Patents disclose motion detection alerting devices, such as those used on vehicles, bicycles and children's toys.

U.S. Pat. No. 4,980,667 (Ames) discloses a bicycle alarm device for audibly warning the bicycle owner that his/her bicycle is being moved impermissibly.

U.S. Pat. No. 5,294,914 (Dallas) discloses a bicycle helmet warning system to alert the seated rider that the helmet stowed in a helmet holder of the bicycle is not being worn.

U.S. Pat. No. 4,016,538 (Miller) discloses a safety device for a motorcycle which includes a device that actuates the horn of a motorcycle if the side stand is down, the ignition is on, and the motorcycle is in the driving position.

In U.S. Pat. No. 5,316,515 (Hyman et al.) discloses a child's toy that is worn by the child and includes, among other things, a motion switch for detecting movements of the toy and for generating sounds responsive to the movements.

In U.S. Pat. No. 4,051,397 (Taylor) discloses a two-sensitivity level kinetic sensor that activates an alarm circuit whenever the surface, upon which the sensor is disposed, is moved.

In U.S. Pat. No. 4,229,663 (Sibley) discloses a device for sensing vehicular mechanical motion.

In U.S. Pat. No. 4,412,205 (Von Kemenczky) discloses a switch device for use on an illuminated article worn by a user that illuminates when certain motions are made by the wearer.

U.S. Pat. No. 5,315,289 (Fuller et al.) discloses an interactive protective system that includes a protective garment worn by the operator and includes sensors which detect respective conditions for alerting the operator about nearby dangers.

U.S. Pat. Nos. 3,870,818 (Barton et al.) and 4,933,852 (Lemelson) disclose apparatus for indicating operational characteristics of a machine, such as a motor vehicle, that utilizes among other things synthetic speech to advise the operator of appropriate action to be taken.

In U.S. Pat. No. 3,436,726 (Dentz) discloses a hood actuated warning device for motor vehicles that warns the operator in the event that the hood of the vehicle is not fully closed at such times when the vehicle is being operated.

However, there remains a need for a compact device that can be integrally formed with almost any movable item that provides an advisory statement to the person who initially moves the item and then remains silent during the item's use, and emits the advisory statement again only after a certain amount of time that the item remains stationary.

OBJECTS OF THE INVENTION

Accordingly, it is the general object of this invention to provide an apparatus which improves upon and overcomes the disadvantages of the prior art.

It is another object of this invention to provide a motion sensitive reminder device that is small in size.

It is still another object of this invention to provide a motion sensitive reminder device that is an integral part of any movable item.

It is still yet another object of this invention to provide a motion sensitive reminder device that minimizes power consumption.

It is even a further object of this invention to provide a motion sensitive reminder device that can emit an audio signal, such as an audible instruction, a sound, or music without becoming a nuisance.

It is still yet a further object of this invention to provide a motion sensitive reminder device that automatically resets itself under predetermined conditions.

It is still yet another object of this invention to provide a motion sensitive reminder device that indicates to the user when power is low.

SUMMARY OF THE INVENTION

These and other objects of the instant invention are achieved by providing a motion sensitive reminder apparatus that is part of any item that is movable. The motion sensitive reminder comprises a housing that forms an integral portion of the movable item. The housing comprises a speaker for emitting an audio signal (e.g., at least one audible statement, music, beeping or any other type of sound), a motion sensor for detecting movement of the movable item, and electronic control means. The electronic control means is electrically coupled to the speaker and to the motion sensor and controls the speaker emission. The electronic control means activates the speaker to emit the audio signal for a predetermined period of time whenever the movable item is initially moved and thereafter silences the speaker during further motion of the movable item. The electronic control means resets the speaker to prepare to emit the audio signal again whenever the movable item has remained stationary for a certain amount of time.

DESCRIPTION OF THE DRAWINGS

Other objects and many of the attendant advantages of this invention will be readily appreciated as the same becomes better understood by reference to the following detailed description when considered in connection with the accompanying drawings wherein:

FIG. 3 depicts the motion sensitive reminder as an integral portion of a roller blade; and FIG. 4 is an enlarged view of the motion sensitive reminder of FIG. 3.

DETAILED DESCRIPTION OF THE PREFERRED EMBODIMENT

Figure 1:
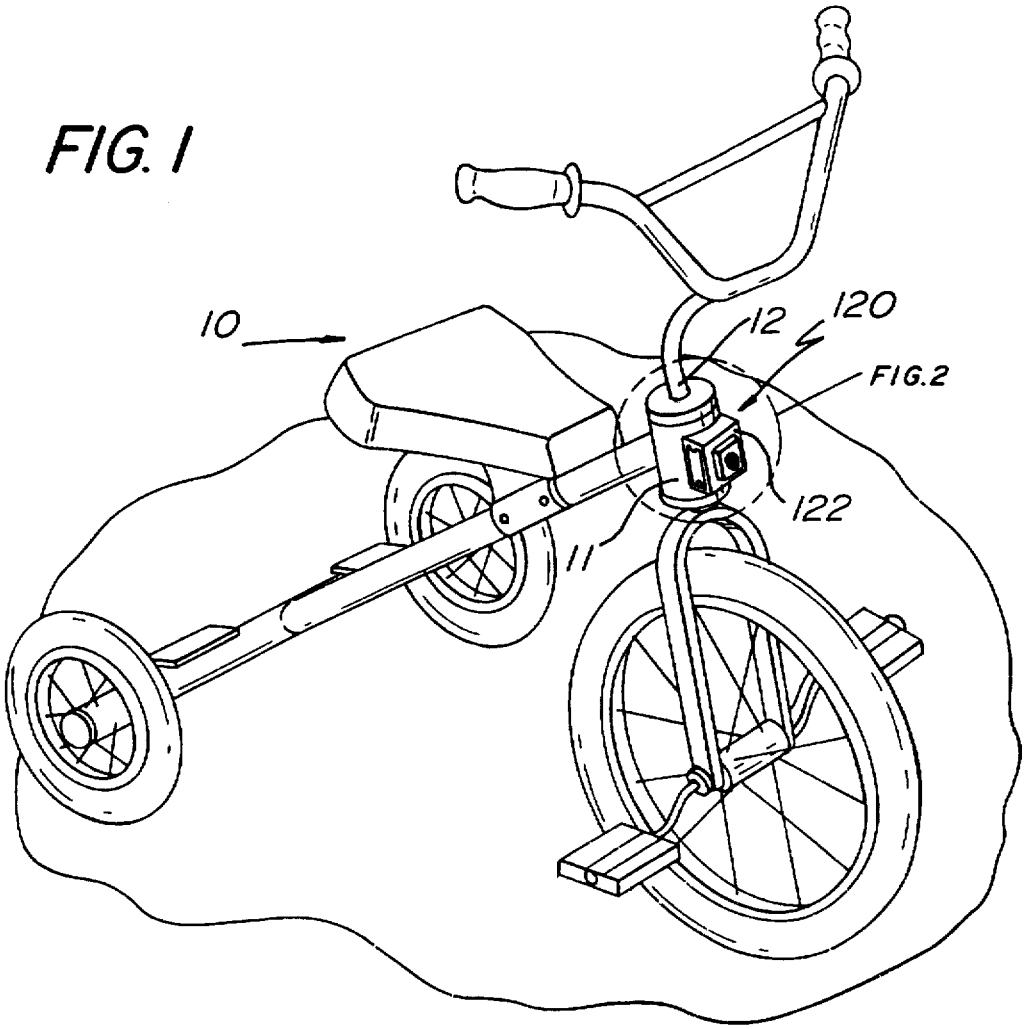
FIG. 1 depicts the motion sensitive reminder as an integral portion of a tricycle.

Referring now in detail to the various figures of the drawing wherein like reference characters refer to like parts, there is shown at 120 in FIG. 1, a motion sensitive reminder (hereinafter "MSR") that is integrally formed with a portion of a tricycle 10.

Figure 2:
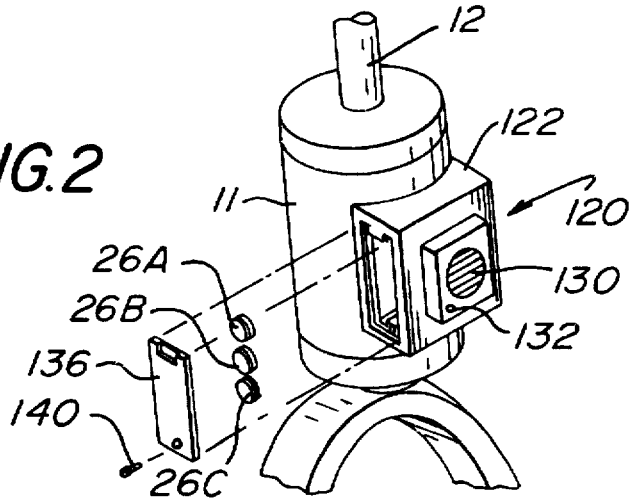
FIG. 2 is enlarged view of the motion sensitive reminder of FIG. 1.

As shown more clearly in FIG. 2, the MSR 120 is a compact unit that comprises an integral housing 122 for supporting a speaker (not shown) located behind a protective grill 130, three button battery cells 26A–26C and a PCB board (not shown) for supporting the electronics (also not shown); a low battery voltage indicator 132 is also positioned adjacent the protective grill 130. In addition, a battery compartment door 136 is releasably secured to the housing 122 via a securement means (e.g., a screw 140) to allow for battery replacement. In all other respects, the MSR 120 is similar in operation to the MSR 20 disclosed in application Ser. No. 08/764,823 filed Dec. 12, 1996 (whose disclosure is incorporated by reference herein) and, as such, the detail of that operation is not repeated here.

The integral housing 122 of the MSR 120 permits the MSR 120 to be part of the production of the movable item (e.g., the tricycle 10). In particular, the MSR 120 is shown in FIGS. 1–2 with the integral housing 122 forming a part of the collar 11 of the handle bar column 12.

Thus, whenever the tricycle 10 is initially moved from a rest condition, the MSR 120 emits a sound for a predetermined period (e.g., approximately 6 seconds) and then becomes silent as long as further motion of the tricycle 10 continues. Should the tricycle 10 remain stationary for a longer period of time (e.g., approximately 1 minute), the electronics prepare the MSR 120 to emit a sound once the tricycle 10 is initially moved from rest again.

FIGS. 3–4 depict another variation of the MSR 120. In particular, a MSR 220 is integrally formed with a portion of a roller blade 14. The MSR 220 is also a compact unit that comprises an integral housing 222 located at the back portion of the roller blade 14; a protective grill 230, behind which is a speaker (not shown), faces outward away from the back of the roller blade 14, as can be seen in FIG. 4; a low battery voltage indicator 232 is also positioned adjacent the protective grill 130. The battery compartment is located on the inside portion of the roller blade 14. A battery compartment door 236 is releasably secured (e.g., friction fit) to allow for battery replacement. In all other respects, the MSR 220 is similar in operation to the MSR 20 disclosed in application Ser. No. 08/764,823 filed Dec. 12, 1996 (whose disclosure is incorporated by reference herein) and, as such, the detail of that operation is not repeated here.

Thus, whenever the roller blade 14 is initially moved from a rest condition, the MSR 220 emits a sound for a predetermined period (e.g., approximately 6 seconds) and then becomes silent as long as further motion of the roller blade 14 continues. Should the roller blade 14 remain stationary for a longer period of time (e.g., approximately 1 minute), the electronics prepare the MSR 220 to emit a sound once the roller blade 14 is initially moved from rest again.

It is thus within the broadest scope of the present invention that the MSR form an integral portion of almost any movable item (e.g., bicycle, motorcycle, skateboard, scooter, etc.) by being part of the manufacturing of the movable item itself, as opposed to the MSR being attachable to any existing movable item, as disclosed in application Ser. No. 08/764,823 filed Dec. 12, 1996.

The location of the integral housing 122/222 is by way of example and not limitation. It should be understood that any portion of the movable item may serve as the site of the integral housing 122/222; the actual site selected for the integral housing 122 on the movable item may depend on other factors particular to the movable item, such as: the cost to manufacture the movable item with the MSR at the proposed site, assembly concerns, machining concerns, clearance problems, safety concerns, etc. Such problems are readily dealt with by those skilled in the art of design and manufacturing.

Without further elaboration, the foregoing will so fully illustrate our invention that others may, by applying current or future knowledge, readily adopt the same for use under various conditions of service.

We claim:

1. A motion sensitive reminder apparatus being part of any item that is movable, said motion sensitive reminder comprising:

a housing being formed as an integral portion of the movable item, said housing comprising:

a speaker for emitting an audio signal;

a motion sensor for detecting movement of the movable item;

electronic control means, electrically coupled to said speaker and to said motion sensor, for controlling said speaker emission, said electronic control means activating said speaker to emit said audio signal for a predetermined period of time whenever the movable item is initially moved and thereafter silencing said speaker during further motion of the movable item and resetting said speaker to prepare to emit said audio signal again whenever the movable item has remained stationary for a certain amount of time.

2. The apparatus of claim 1 wherein said predetermined period is approximately 6 seconds.

3. The apparatus of claim 1 wherein said certain amount of time is approximately 1 minute.

4. The apparatus of claim 1 wherein said audio signal comprises at least one audible statement.

5. The apparatus of claim 1 wherein said audio signal comprises a sound.

6. The apparatus of claim 1 wherein said audio signal comprises music.

7. The apparatus of claim 1 wherein said electronic control means resides on a single die.

8. The apparatus of claim 7 wherein said electronic control means comprises an audio circuit for providing an electrical signal representative of said audio signal to said speaker, said motion sensor being coupled to said audio circuit through a motion switching circuit that is coupled to said motion sensor.

9. The apparatus of claim 8 wherein said audio circuit comprises a timer for terminating said electrical signal representative of said audio signal after said predetermined period of time.

10. The apparatus of claim 8 wherein said electronic control means further comprises a reset means, coupled between said motion switching circuit and said audio circuit, for resetting the electronic control means whenever said apparatus remains stationary for said certain amount of time.

11. The apparatus of claim 10 wherein said motion switching circuit generates an alternating wave whenever said apparatus is in motion.

12. The apparatus of claim 7 wherein said audio circuit is digital.

13. The apparatus of claim 7 wherein said apparatus further comprises batteries and said electronic control means further comprises a low battery voltage detector coupled to the batteries, said low battery voltage detector monitoring the voltage of the batteries and activating an indicator whenever the voltage falls to a predetermined value.

14. The apparatus of claim 13 wherein said low battery voltage detector is coupled to said motion sensor, said motion sensor enabling said low battery voltage detector to activate said indicator when said motion sensor is detecting motion.

15. The apparatus of claim 14 wherein said low battery voltage detector causes said indicator to flash to conserve power during a low battery voltage condition.

16. The apparatus of claim 1 wherein said electronic control means comprises an audio circuit for providing an electrical signal representative of said audio signal to said speaker, said motion sensor being coupled to said audio circuit through a motion switching circuit that is coupled to said motion sensor.

17. The apparatus of claim 16 wherein said audio circuit comprises a timer for terminating said electrical signal representative of said audio signal after said predetermined period of time.

18. The apparatus of claim 16 wherein said electronic control means further comprises a reset means, coupled between said motion switching circuit and said audio circuit, for resetting the electronic control means whenever said apparatus remains stationary for said certain amount of time.

19. The apparatus of claim 18 wherein said motion switching circuit generates an alternating wave whenever said apparatus is in motion.

20. The apparatus of claim 19 wherein said reset means comprises a resistor-capacitor-diode network, said resistor and diode being connected in parallel with said capacitor coupled in series with said parallel connected resistor and diode, said diode and capacitor forming a quick discharge path for discharging said capacitor whenever said apparatus is in motion, and said resistor causing said capacitor to charge for said certain amount of time whenever said apparatus is stationary for said certain amount of time, thereby resetting said speaker to prepare to emit again said audio signal.

21. The apparatus of claim 16 wherein said apparatus further comprises batteries and said electronic control means further comprises a low battery voltage detector coupled to the batteries, said low battery voltage detector monitoring the voltage of the batteries and activating an indicator whenever the voltage falls to a predetermined value.

22. The apparatus of claim 21 wherein said low battery voltage detector is coupled to said motion sensor, said motion sensor enabling said low battery voltage detector to activate said indicator when said motion sensor is detecting motion.

23. The apparatus of claim 22 wherein said low battery voltage detector causes said indicator to flash to conserve power during a low battery voltage condition.

24. The apparatus of claim 16 wherein said audio circuit is digital.

* * * * *